US007938264B2

(12) United States Patent
Yoshifusa

(10) Patent No.: US 7,938,264 B2
(45) **Date of Patent: *May 10, 2011**

(54) STRUCTURE OF AIR-PACKING DEVICE

(75) Inventor: Kark K. Yoshifusa, Lake Forest, CA (US)

(73) Assignee: Air-Paq, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/205,720

(22) Filed: Sep. 5, 2008

(65) Prior Publication Data

US 2008/0314783 A1 Dec. 25, 2008

Related U.S. Application Data

(63) Continuation of application No. 11/252,079, filed on Oct. 17, 2005, now Pat. No. 7,422,108.

(51) Int. Cl.
*B65D 81/03* (2006.01)
*B65D 81/02* (2006.01)

(52) U.S. Cl. ..... 206/522; 383/3

(58) Field of Classification Search ..... 206/521, 206/522, 591, 592, 593, 594; 383/37, 38, 383/109, 3; 410/119; 428/35.2, 178, 188; 441/40, 41

See application file for complete search history.

(56) References Cited

U.S. PATENT DOCUMENTS 4,465,188 A * 8/1984 Soroka et al. ..... 206/522
4,850,912 A * 7/1989 Koyanagi ..... 441/40
5,427,830 A * 6/1995 Pharo ..... 428/35.2
5,445,274 A * 8/1995 Pharo ..... 206/522
5,454,642 A * 10/1995 De Luca ..... 383/3
5,469,966 A * 11/1995 Boyer ..... 206/522
5,570,788 A * 11/1996 Batsford ..... 206/522
5,620,096 A * 4/1997 Pozzo ..... 206/450
5,826,723 A * 10/1998 Jaszai ..... 206/522
5,857,571 A * 1/1999 Tschantz et al. ..... 206/522
6,520,332 B1 * 2/2003 Barmore et al. ..... 206/522
6,520,333 B1 * 2/2003 Tschantz ..... 206/522
6,629,777 B2 * 10/2003 Tanaka et al. ..... 383/3
6,755,568 B2 * 6/2004 Malone et al. ..... 383/3
7,165,677 B2 * 1/2007 Tanaka et al. ..... 206/522
7,228,969 B2 * 6/2007 Nakano ..... 206/522
7,297,387 B2 * 11/2007 Koyanagi ..... 428/166
7,410,057 B2 * 8/2008 Yoshifusa ..... 206/522
7,422,108 B2 * 9/2008 Yoshifusa ..... 206/522
7,422,109 B2 * 9/2008 Yoshifusa ..... 206/522
7,464,520 B2 * 12/2008 Nishi et al. ..... 53/472
7,482,051 B2 * 1/2009 Tanaka et al. ..... 428/178
2004/0149618 A1 * 8/2004 Otaki et al. ..... 206/521
2004/0211697 A1 * 10/2004 Nakano ..... 206/522

(Continued)

*Primary Examiner* — David T Fidei
(74) *Attorney, Agent, or Firm* — Finnegan, Henderson, Farabow, Garrett & Dunner, LLP

(57) ABSTRACT

An air-packing device inflatable by compressed air for protecting a product, where the air-packing device is used in a pair to securely hold the product for protection. The air-packing device is configured by an inflated portion that has a plurality of air containers, each of the air container having a check valve that prevents reverse flow of air, an uninflated portion that is not filled with compressed air, an air input commonly connected to the plurality of check valves to supply the compressed air to the air cells through the check valves. The plurality of air containers create an enclosure structure to surround one end of the product to be protected, and the uninflated portion is flipped inside the enclosure structure to create a pouch portion that holds the package to be protected.

6 Claims, 16 Drawing Sheets

U.S. PATENT DOCUMENTS

2005/0006271 A1* 1/2005 Nakagawa ..... 206/521
2005/0109656 A1* 5/2005 Ishizaki ..... 206/522
2006/0210773 A1* 9/2006 Kannankeril ..... 428/166

* cited by examiner

PRIOR ART

PRIOR ART

STRUCTURE OF AIR-PACKING DEVICE

This is a continuation of application Ser. No.11/252,079, filed Oct. 17, 2005, now U.S. Pat. No. 7,422,108, issued Sep. 9, 2008 both of which are incorporated herein by reference.

FIELD OF THE INVENTION

This invention relates to a structure of an air-packing device for use as packing material, and more particularly, to a structure of an air-packing device for achieving an improved shock absorbing capability to protect a product from a shock or impact characterized as having an inflated portion and an uninflated pouch portion.

BACKGROUND OF THE INVENTION

In product distribution channels such as product shipping, a Styrofoam packing material has been used for a long time for packing commodity and industrial products. Although the styrofoam package material has a merit such as a good thermal insulation performance and a light weight, it has also various disadvantages: recycling the styrofoam is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of sealingly containing a liquid or gas such as air (hereafter also referred to as an "air-packing device"). The air-packing device has excellent characteristics to solve the problems involved in the styrofoam. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of structure of an air-packing device in the conventional technology. The air-packing device 20 includes a plurality of air containers 22 and check valves 24, a guide passage 21 and an air input 25. The air from the air input 25 is supplied to the air containers 22 through the air passage 21 and the check valves 24. Typically, the air-packing device 20 is composed of two thermoplastic films which are bonded together at bonding areas 23*a*.

Each air container 22 is provided with a check valve 24. One of the purposes of having multiple air containers with corresponding check valves is to increase the reliability, because each air container is independent from the others. Namely, even if one of the air containers suffers from an air leakage for some reason, the air-packing device can still function as a shock absorber for packing the product because other air containers are still inflated due to the corresponding check valves.

FIG. 2 is a plan view of the air-packing device 20 of FIG. 1 when it is not inflated which shows bonding areas for closing two thermoplastic films. The thermoplastic films of the air-packing device 20 are bonded (heat-sealed) together at bonding areas 23*a* which are rectangular periphery thereof to air tightly close the air-packing device 20. The thermoplastic films of the air-packing device 20 are also bonded together at bonding areas 23*b* which are boundaries of the air containers 22 to air-tightly separate the air containers 22 from one another.

When using the air-packing device, each air container 22 is filled with the air from the air input 25 through the guide passage 21 and the check valve 24. After filling the air, the expansion of each air container 22 is maintained because each check-valve 24 prevents the reverse flow of the air. The check valve 24 is typically made of two small thermoplastic films which are bonded together to form an air pipe. The air pipe has a tip opening and a valve body to allow the air flowing in the forward direction through the air pipe from the tip opening but the valve body prevents the air flow in the backward direction.

Air-packing devices are becoming more and more popular because of the advantages noted above. There is an increasing need to store and carry precision products or articles which are sensitive to shocks and impacts often involved in shipment of the products. There are many other types of product, such as wine bottles, DVD drivers, music instruments, glass or ceramic wares, antiques, etc. that need special attention so as not to receive a shock, vibration or other mechanical impact. Thus, it is desired that the air-packing device protects the product to minimize the shock and impact. In case the product to be protected has a pointed end, the possibility exists that the air-packing device may be ruptured by it. Thus, it is also desired that the air-packing device does not rupture during transportation.

SUMMARY OF THE INVENTION

It is, therefore, an object of the present invention to provide a structure of an air-packing device for packing a product that can minimize a shock or vibration and protect the product.

It is another object of the present invention to provide a structure of an air-packing device for packing a product by a packing space created by the air-packing device unique to a particular product.

It is a further object of the present invention to provide a structure of an air-packing device that has improved durability to prevent rupture of the air-packing device caused by a pointed corner of a product.

An air-packing device inflatable by compressed air for protecting a product, where the air-packing device is used in a pair to securely hold the product for protection, comprises first and second thermoplastic films superposed with each other where predetermined portions of the first and second thermoplastic films are bonded, thereby creating a plurality of air containers, inflated portion that has a plurality of the air containers, each of the air container having a check valve that prevents reverse flow of air, uninflated portion that is not filled with compressed air, an air input commonly connected to the plurality of check valves to supply the compressed air to the air cells through the check valves. The plurality of air containers create an enclosure structure to surround one end of the product to be protected, and the uninflated portion is flipped inside the enclosure structure to create a pouch that holds the package.

The air-packing device under the present invention may further comprises a plurality of heat-seal lands each sealing the first and second thermoplastic films in a small area of the air container in a manner to allow air flow between the air cells, thereby creating a plurality of series connected air cells for each air container.

In one aspect of the present invention, the air-packing device further comprises a block portion that bonds the first and second thermoplastic films in the air input to block the flow of air to the uninflated portion while supplying the compressed air to the air cells through the check valves.

In another aspect of the present invention, the air-packing device has the enclosure structure formed by the plurality of the air containers is substantially trapezoid shape.

In still another aspect of the present invention, the air-packing device has the enclosure structure formed by the plurality of the air containers is substantially oval shape.

The uninflated portion of the air-packing device under the present invention may be a simple structure which lacks the air containers that store compressed air.

According to the present invention, the air-packing device can minimize the shocks or vibrations to the product when the product is dropped or collided. The air-packing device is comprised of multiple rows of air containers each having a plurality of air cells connected in series. After being inflated by the compressed air, the air-packing device is folded to make an enclosure portion that is filled with compressed air. A pouch portion of the air-packing device which is not inflated with the air acts as a pouch that holds a product to be protected while preventing rupture of the air containers by preventing direct contact of the product to the inflated portion.

DETAILED DESCRIPTION OF THE INVENTION

The air-packing device of the present invention will be described in more detail with reference to the accompanying drawings. It should be noted that although the present invention is described for the case of using an air for inflating the air-packing device for an illustration purpose, other fluids such as other types of gas or liquid can also be used. The air-packing device is typically used in a container box to pack a product during the distribution channel of the product.

The air-packing device of the present invention is especially useful for packing products which are sensitive to shock or vibration such as hard disk drives, personal computers, DVD drivers, bottles, glassware, ceramic ware, music instruments, paintings, antiques, etc. Especially, the air-packing device of the present invention is most advantageously applied for packing a toner cartridge of a printer and a facsimile machine. The air-packing device reliably wraps the product within a pouched area of the air-packing device to securely hold the product to be protected. The wrapped product and the air-packing device are then placed in a container box. Thus, the air-packing device absorbs the shocks and impacts applied to the product when, for example, the product is inadvertently dropped on the floor or collided with other objects.

The air-packing device of the present invention includes a plurality of air containers each having a plurality of serially connected air cells, and a pouched area that acts as a pocket to hold a product. The air container is air-tightly separated from the other air containers while the air cells in the same air container are connected by the air passages such that the air can flow among the air cells through the air passages. Each air cell in the air container has a sausage like shape when the air is filled in the air containers.

Figure 1:
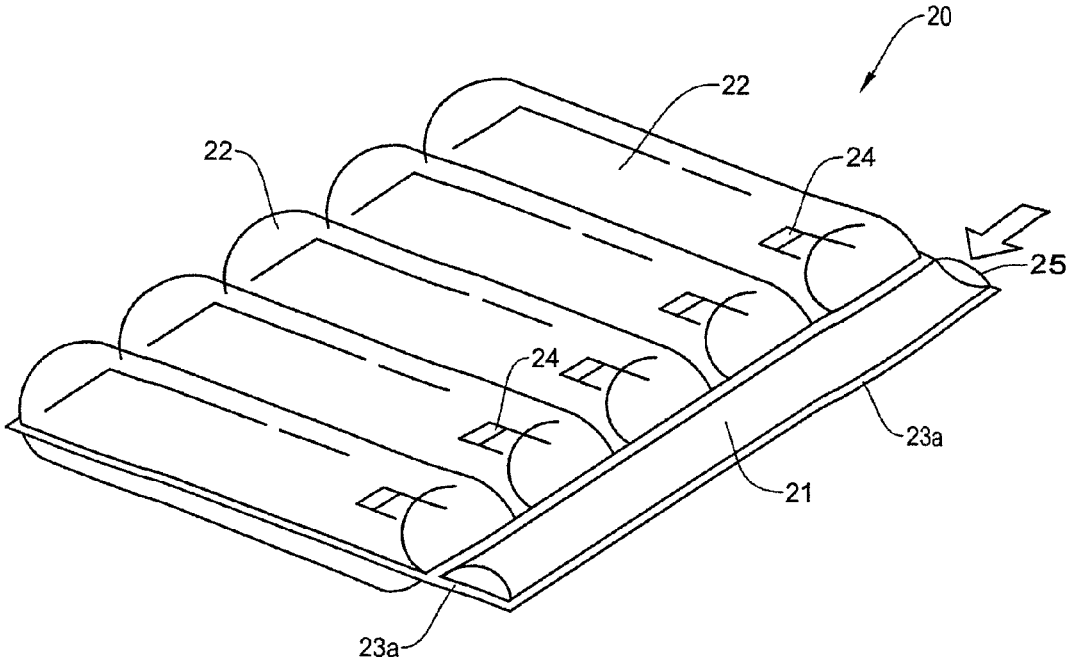
FIG. 1 is a schematic perspective view showing an example of basic structure of an air-packing device in the conventional technology.
Figure 2:
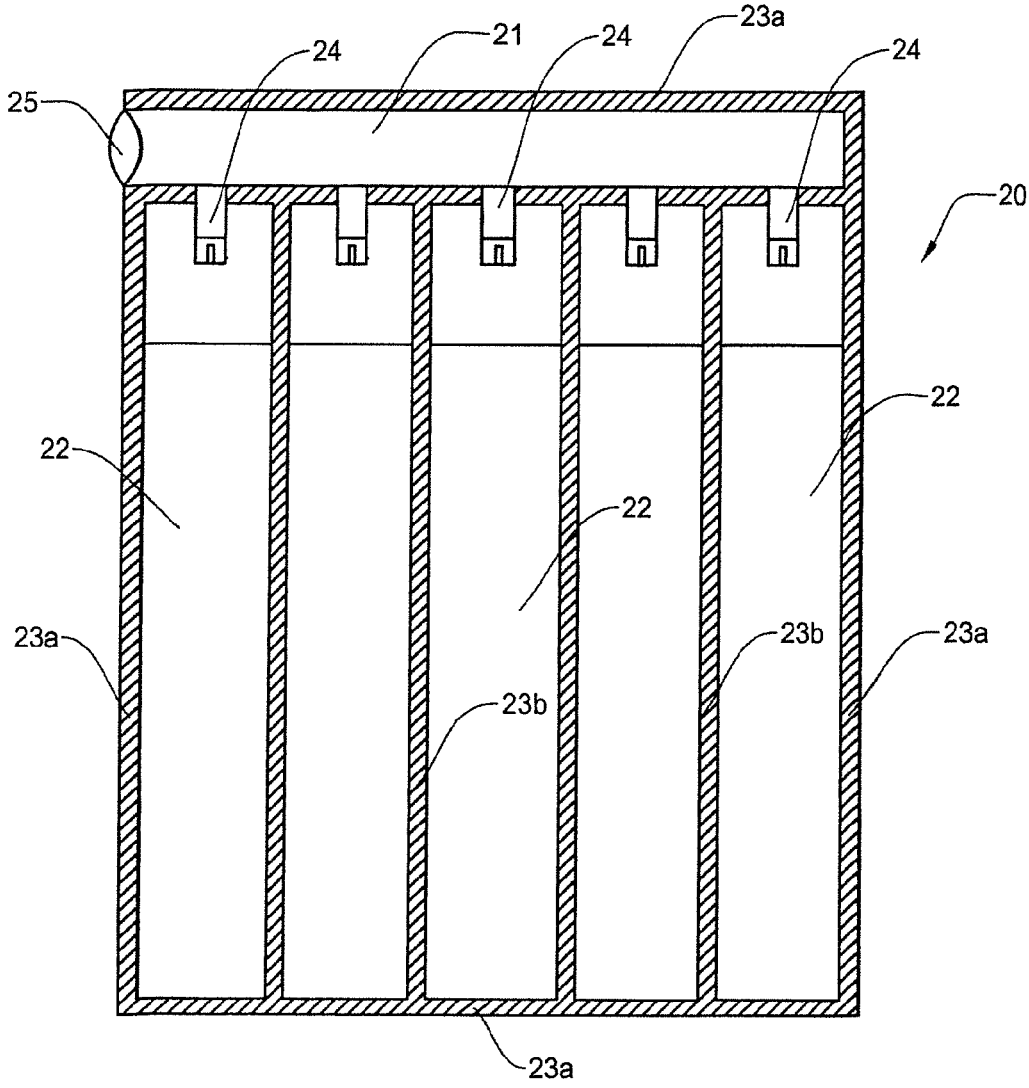
FIG. 2 is a plan view of the air-packing device 20 of FIG. 1 when it is not inflated for showing bonding areas for closing two thermoplastic films.
Figure 3:
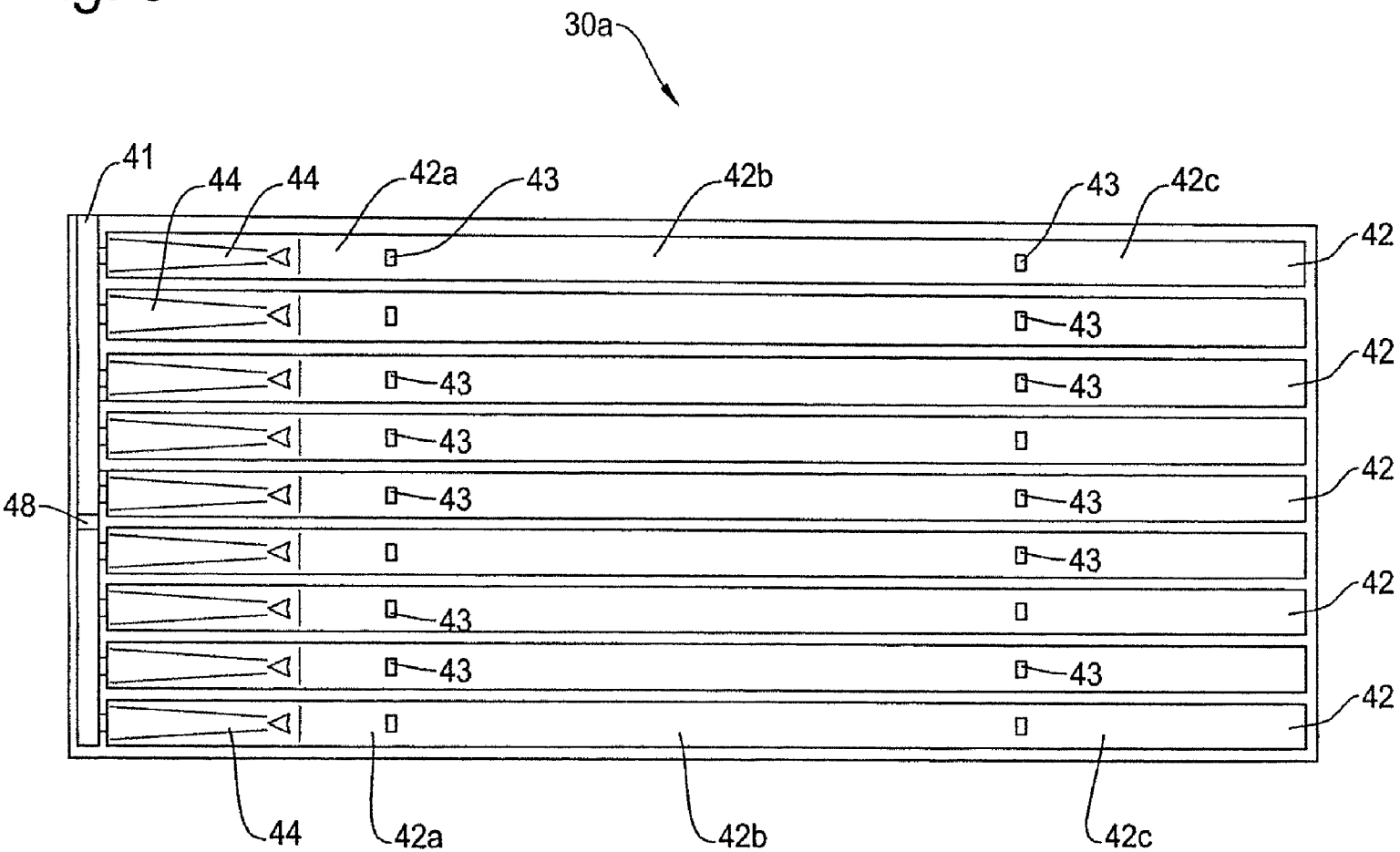
FIG. 3 is a plane view of the air-packing device under the present invention wherein the air-packing device is not inflated.

One embodiment of the present invention is described with reference to FIGS. 3 to 6. FIG. 3 is a plan view showing an air-packing device of the present invention before being inflated by air. This configuration is especially suited to hold and protect a toner cartridge of a printer or a facsimile machine. It should be noted that this air-packing device 30*a* is used in a pair to protect a product. An actual example of using the air-packing device 30*a* is shown in the perspective view of FIG. 6, wherein a pair of air-packing devices 30*a* hold a product 111 such as a toner cartridge.

Referring back to FIG. 3, the air-packing device 30*a* is made of two thermoplastic films which are bonded (heat-sealed) together to create the plurality of air containers 42. Such bonded areas are denoted by reference numerals 46 and 47 which air-tightly separate the air containers 42 from one another. In the air-packing device 30*a*, each air container 42 has a plurality of serially connected air cells 42*a*-42*c*. In this drawing, the left edge and the right edge of the air-packing device 30*a* are not bonded with each other, but they will be bonded to form a continuous plane when the air-packing device 30*a* is used in practice as will be explained later in detail.

More specifically, the air cells 42*a*-42*c* connected in series are created by bonding (heat-sealing) the two thermoplastic films of the air container 42 at each small heat-seal land (separator) 43. The heat-seal lands 43 are small area on the air container 42 and do not completely separate the adjacent air cells 42*a*-42*c*. Thus, two small air passages (upper side and lower side of the heat-seal land 43) are created for allowing the air to flow therethrough toward the next air cell. The heat-seal lands 43 are provided to create the air cells 42*a*-42*c* as well as to define the locations for folding the air-packing device 30*a*. In other words, the locations of the heat-seal lands 43 are uniquely arranged to create a specific shape of the air-packing device when wrapping a product.

Typically, each air container 42 is provided with a check valve 44 at one end so that the compressed air is maintained in the air container because the check valve 44 prohibits a reverse flow of the air. In the example of FIG. 3, the check valves 44 are provided at the left end of the air-packing device 30*a* and are commonly connected to an air input 41. When the compressed air is supplied through the air input 41, the air flows through the check valves 44 and inflates all of the air cells 42*a*-42*c*.

In the present invention, the air introduced from the air input 41 is blocked by an air stopper 48 where the films are bonded with each other. The air will flow to the upper six air containers and will not fill the lower four air containers. Thus, only the upper five air containers 42 are filled with the air while the lower four air containers 42 are not inflated. Thus, the lower air containers 42 do not act as a cushion but will act as a pouch to hold a product to be protected as will be explained later in detail. It should be noted that because the lower air containers 42 do not act as a cushion, it is unnecessary to form the air containers 42 which are not inflated by the air. However, to produce the air-packing device 30*a* of the present invention through a standard production machine, the air containers and check valves are formed in the same manner through out the thermoplastic films.

The left edge and the right edge (FIG. 3) of the air-packing device 30*a* are bonded to form a continuous plane, i.e., a loop. Thus, when the air packing device 30*a* is filled with compressed air, the air packing device 30*a* takes the shape shown in the perspective view of FIG. 4A. As shown, the air-packing device 30*a* has an inflated portion 31 and a pouch portion 32 that is not inflated because of the air stopper 48 shown in FIG. 3.

The inflated portion 31 is made of a multiplicity of air containers 42 that are filled with the compressed air and constitutes an enclosure structure. In this example, the inflated portion forms a substantially trapezoid shape having four corners. One corner is formed along the bonding edge where the right and left edges of the air-packing device 30*a* as shown in FIG. 3 are bonded together. Other two corners are formed at the heat-seal lands 43 because the heat-seal lands 43 promote to fold the air-packing device 30*a*.

The remaining one corner (indicated by C) is formed by arbitrarily bending a line that traverses the air cells 42*b* which are much longer than the other air cells. Since this corner C is not bent along the heat seal lands 43, the position of this corner C can be determined in a flexible manner. This configuration helps to adopt the air-packing device 30*a* for various shapes of toner cartridges. In the present embodiment, the inflated portion 31 has substantially trapezoid structure.

The pouch portion 32 itself does not have the capacity to absorb shocks because it is not filled with the compressed air. However, the pouch portion 32 is turned inside out to make a pouch within the enclosure structure formed by the inflated portion 31. Therefore, the pouch portion 32 is suitable to securely hold a product to be protected. It should be noted that the thermoplastic films of the pouch portion 32 are also bonded for forming the air containers 42, the pouch portion 32 is reinforced thereby having a sufficient physical strength with respect to the product received therein.

Figure 4A:
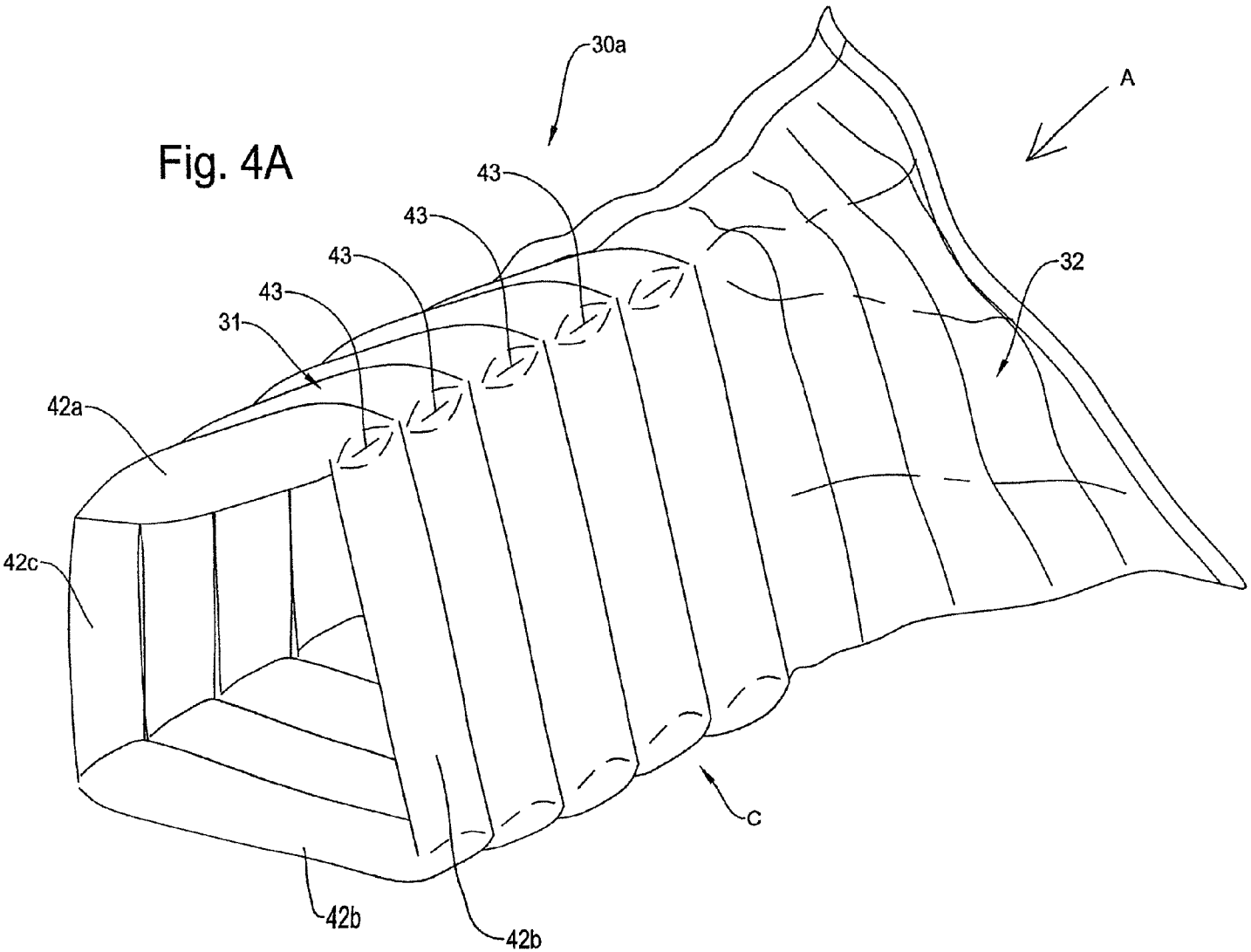
FIG. 4A is a perspective view of the air-packing device under the present invention wherein the air-packing device has an inflated portion and uninflated portion that forms a pouch.
Figure 4B:
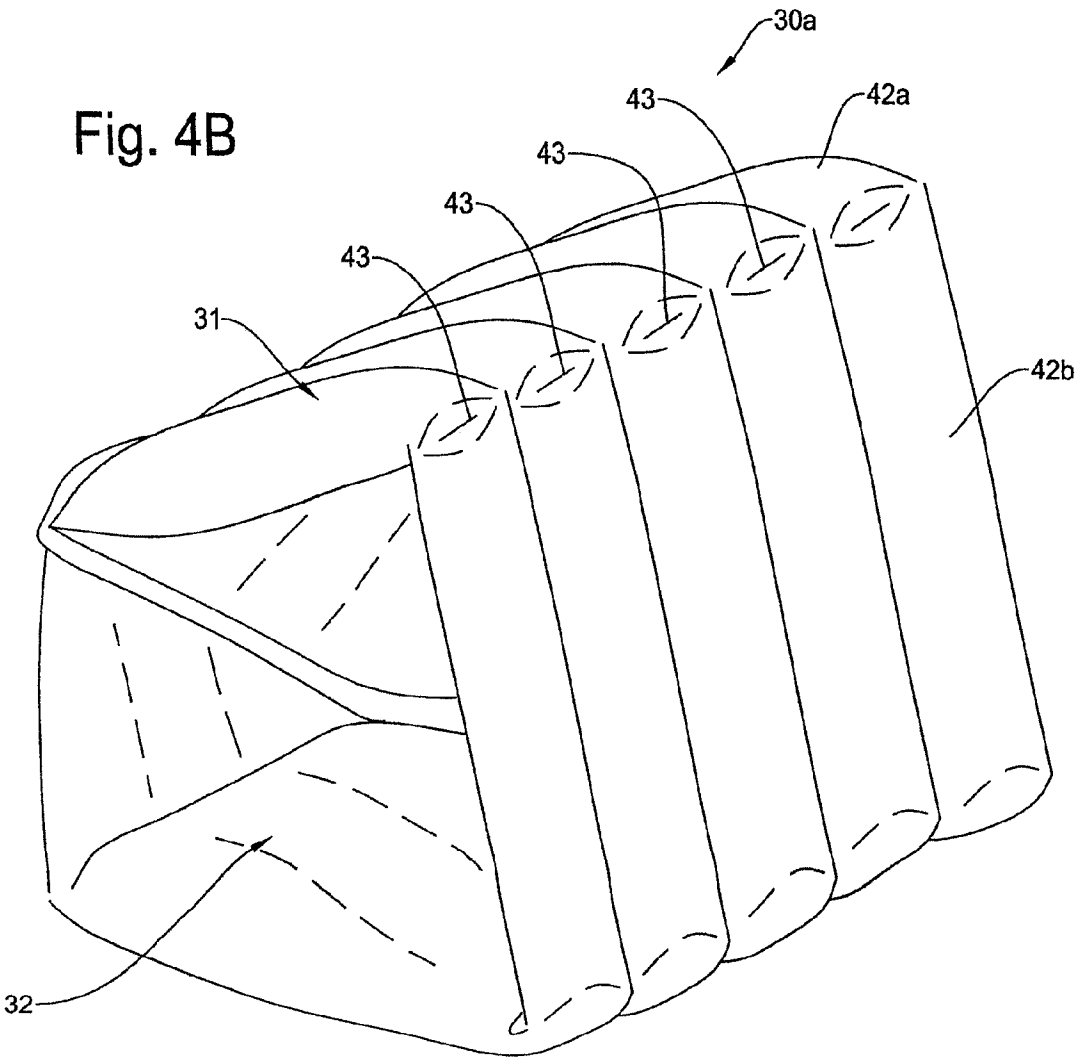
FIG. 4B is a perspective view of the air-packing device under the present invention wherein the air-packing device has an inflated portion and uninflated portion that has been flipped in to form a pouch.

Referring to the perspective view shown in FIG. 4B, the condition of the air-packing device 30*a* wherein the pouch portion 32 is turned inside out to make a pouch is described. In other words, FIG. 4B shows the perspective view of the air-packing device observed from the back (arrow B) of FIG. 4A. As shown, the pouch portion 32 is folded in to make a pouch structure. The position of the air stopper 48 (FIG. 3) is so selected that the bottom of the pouch portion 32 remains within the enclosure structure formed by the inflated portion 31. One end of a product to be protected, such as a toner cartridge of a printer, is inserted into the pouch portion 32 and contact the bottom of the pouch portion while being packed by the inflated portion 31.

The pouch portion 32 can stabilize the position of the product to be protected because the bottom of the pouch portion prevents the product to move toward the end of the inflated portion 31. Moreover, the pouch portion 32 prevents the product from direct contact with the inflated portion 31. Namely, when the product is inserted in the pouch portion 32, the end of the product which sometimes has a sharp edge or corner will not directly touch the inflated portion 31 that is filled with compressed air, which prevents breakage or puncture of the air-packing device 30*a*. In the present embodiment, the pouch portion 32 is made of two sheets of films heat-sealed with one another as noted above, thus, the durability of the air-packing device 30*a* is enhanced. Thus, the pouch portion increases the reliability of the air-packing device 30*a*.

Figure 4C:
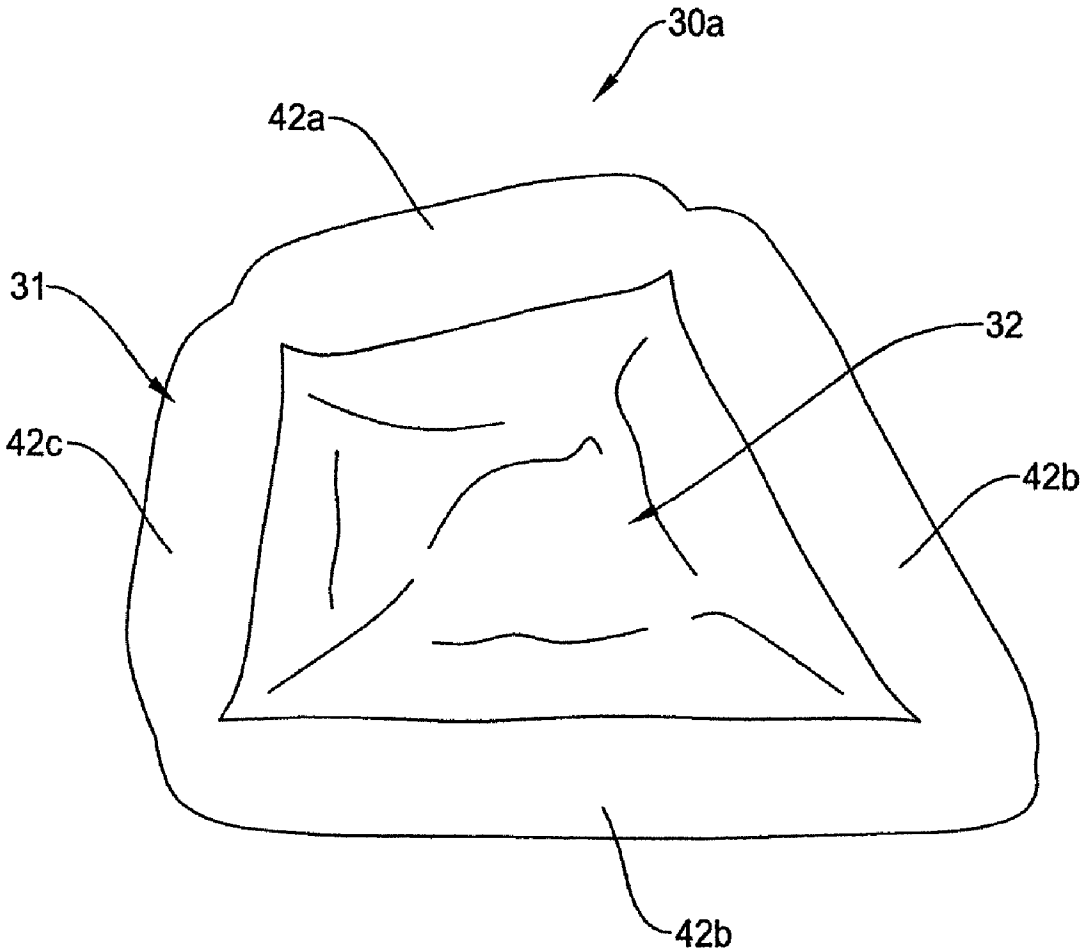
FIG. 4C is a frontal view of the air-packing device viewed from the pouch of the air-packing device that receives a product to be protected.

FIG. 4C is a front view of the pouch portion 32 of the air-packing device 30*a* as depicted in FIG. 4B. The pouch portion 32 is surrounded by the inflated portion 31 that protects the product to be protected because of the cushion function. As noted above, in an actual application, a pair of air-packing devices 30*a* are used to hold a product at each end for protection. Then, the pair of air-packing devices 30*a* packing the product therein is installed in a container box made of hard paper, corrugated fiber board, etc., commonly used in the industry.

Figure 5A:
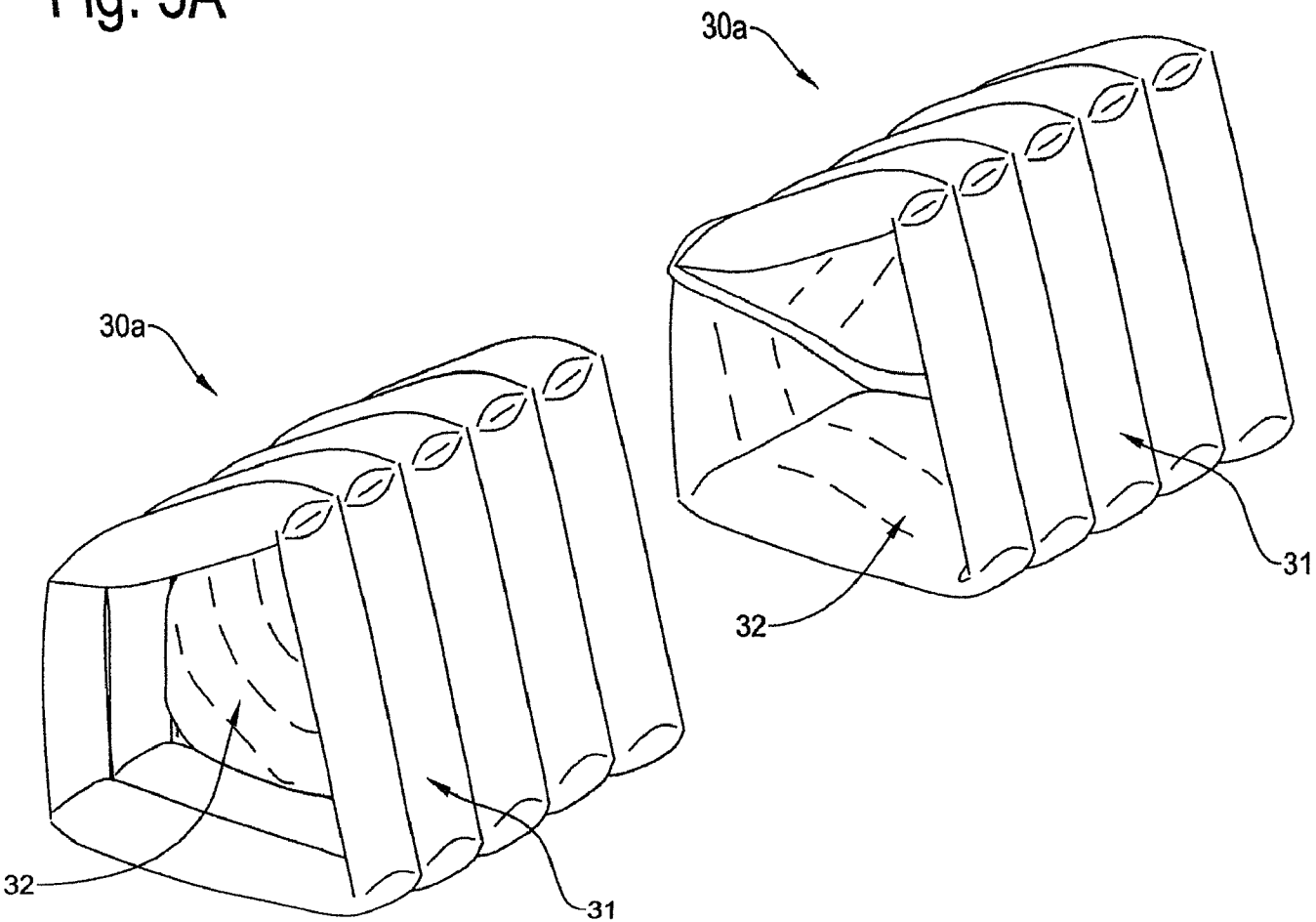
FIG. 5A is a perspective view of a pair of air-packing devices under the present invention that are aligned in the same condition that they are used to protect a package.

FIG. 5A is a perspective view showing a pair of air-packing devices 30*a* that are aligned in the same condition as that when packing the product at its both ends by the air-packing devices 30*a*. The air-packing device 30*a* on the left shows the inflated portion 31 and the back of the pouch portion 32 which is folded inside of the inflated portion 31. The air-packing device 30*b* on the right shows the inflated portion 31 and the front of the pouch 32 which is folded inside of the inflated portion 31.

Figure 5B:
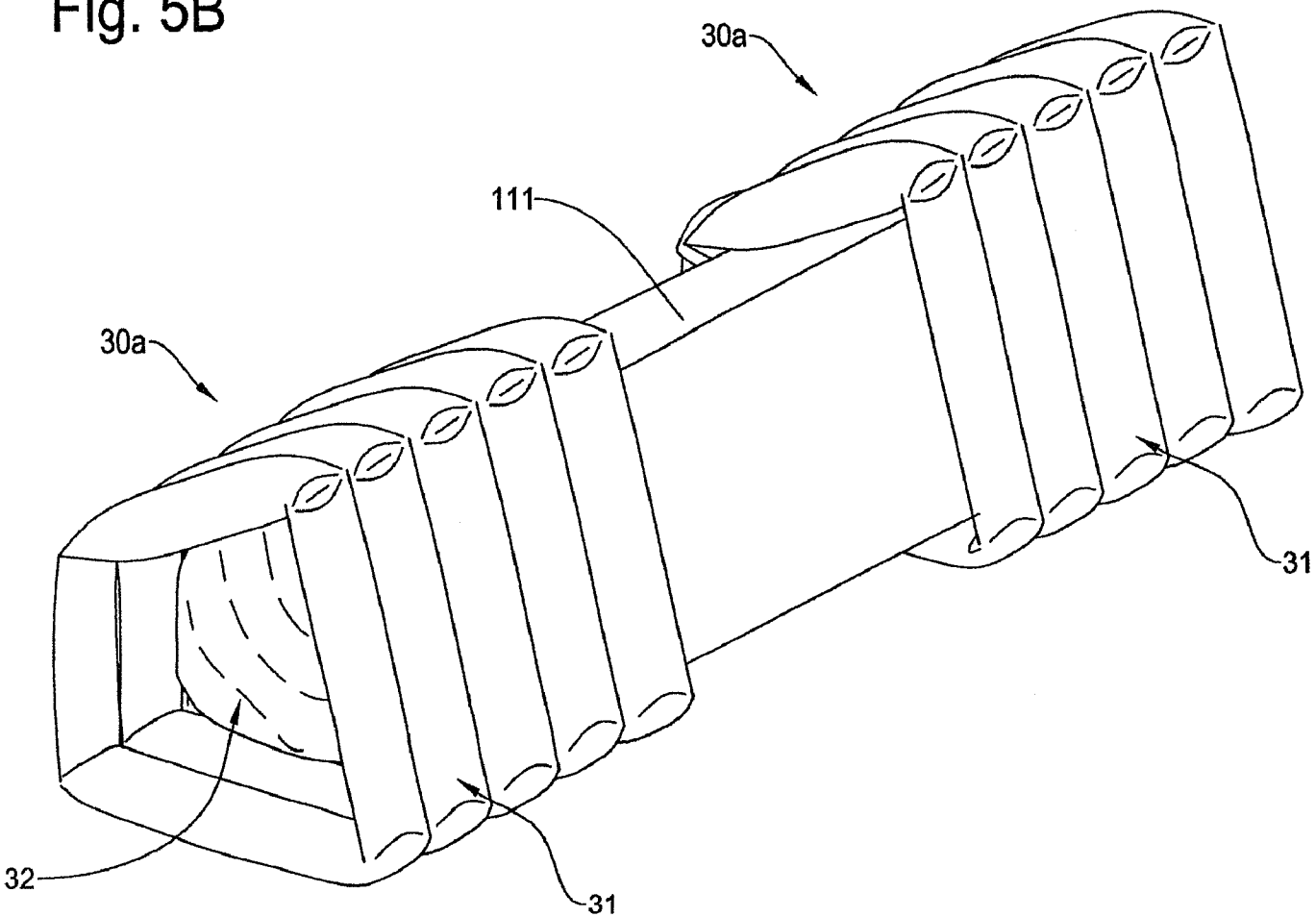
FIG. 5B is a perspective view of a pair of air-packing devices under the present invention and a toner cartridge that is securely held in the pouch portions of the air-packaging devices for protection.

FIG. 5B is a perspective view showing the air-packing devices 30*a* aligned in a manner similar to that of FIG. 5A except that the air-packing devices 30*a* hold the ends of the product to be protected (toner cartridge) for shock absorption. Normally, the toner cartridge and the air-packing devices 30*a* are placed in a container box, such as a corrugated carton, for transportation. Although there are many different types of toner cartridges with different shapes and sizes, the air-packing device 30*a* of the present invention can accommodate all of the types of toner cartridges because of its flexibility, especially, the location C for folding the air cells 42*b* (FIGS. 3 and 4A-4C) can be freely determined.

Figure 5C:
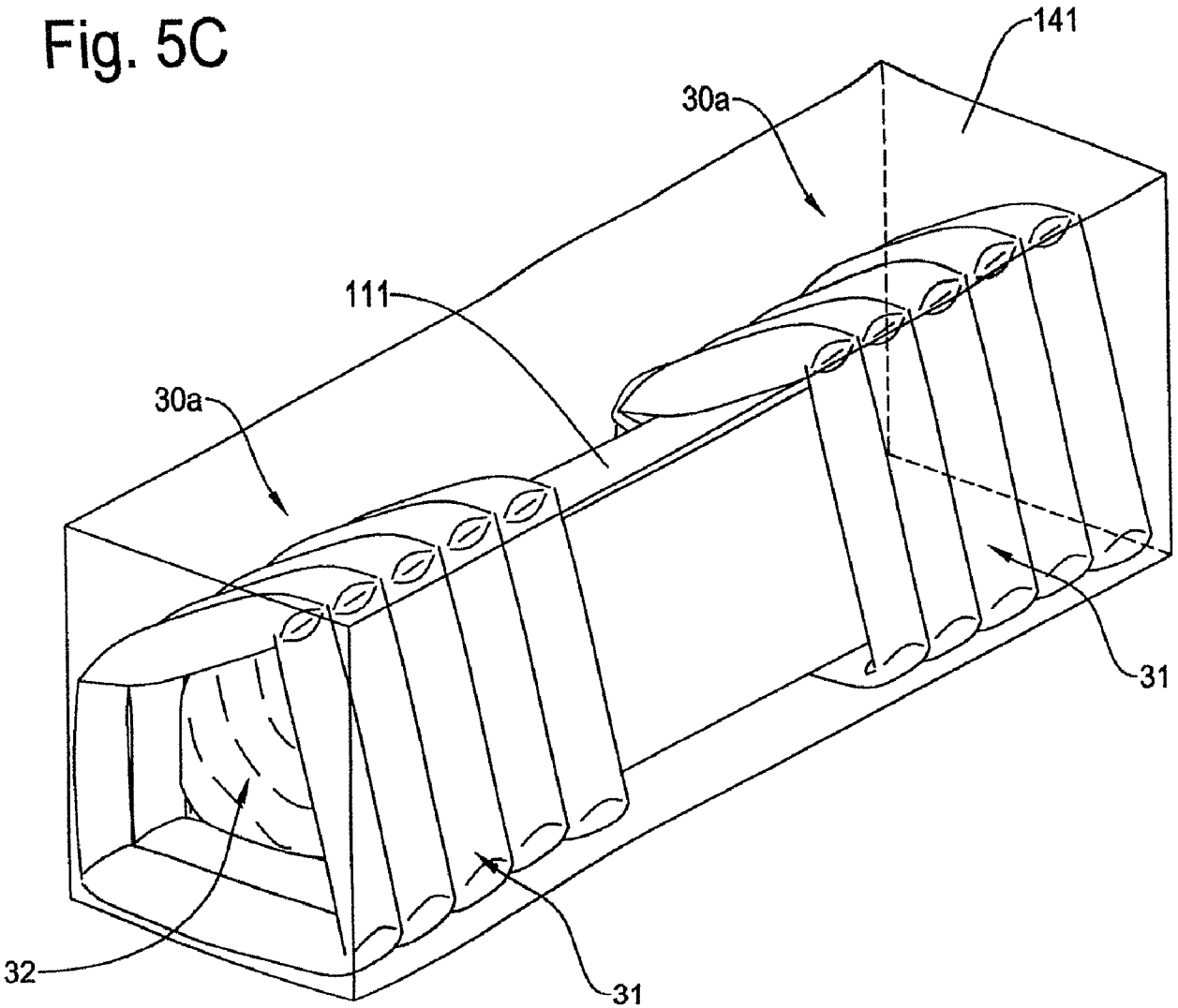
FIG. 5C is a perspective view of a pair of air-packing devices under the present invention and a toner cartridge similar to that in FIG. 5B except that they are placed in a container box.

FIG. 5C is a perspective view wherein the toner cartridge packed by the air-packing devices 30*a* are placed in a container box 141. The container box 141 is preferably of the size that snugly hold the toner cartridge and the air-packing devices 30*a* in the inside. When the product is a type other than the toner cartridge such as a notebook computer, the container box 141 may have other spaces for accessories of the notebook computer.

Figure 6:
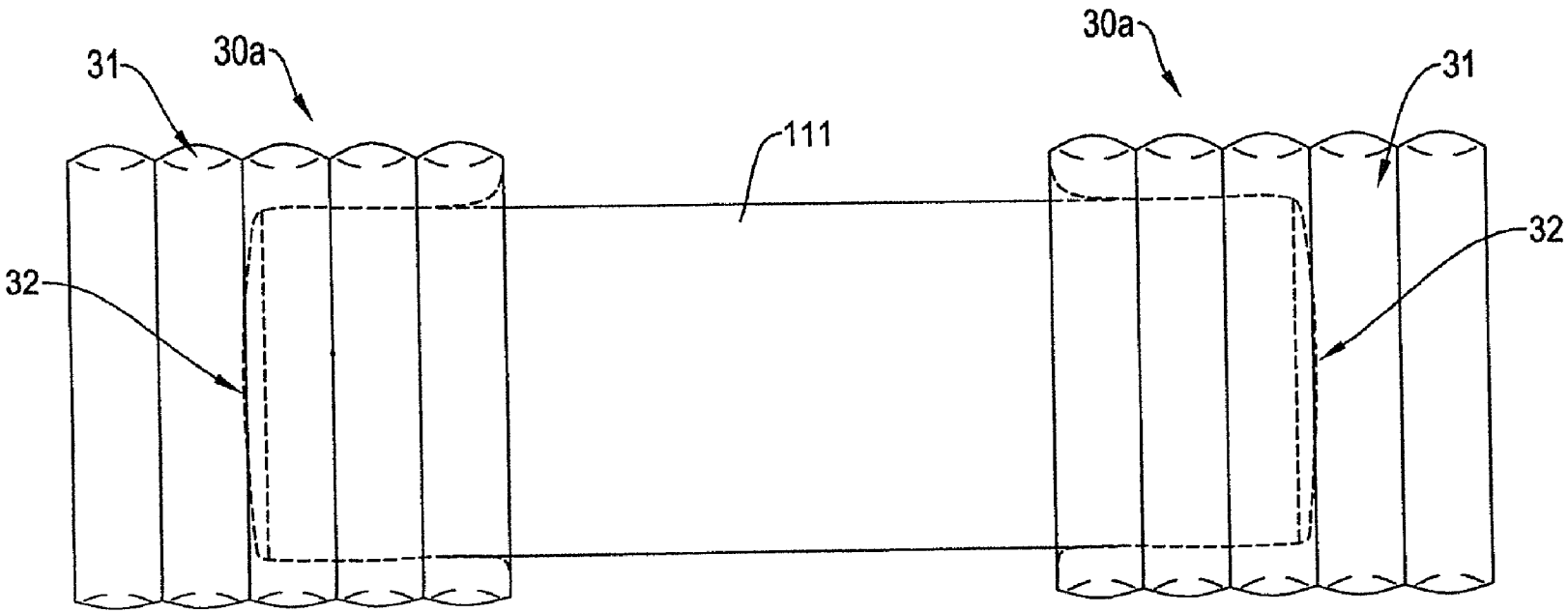
FIG. 6 is a side view of the air-packing devices in the present invention and a toner cartridge hold by a pouch portion of the air-packing devices for protection.

FIG. 6 is a side view showing the pair of air-packing devices 30*a* and the product 111 such as a toner cartridge in the same condition as shown in FIG. 5B. The configuration within the air-packing devices 30*a* is indicated by dotted lines. As shown, the toner cartridge 111 is securely held by the air-packing devices 30*a* provided at both ends of the toner cartridge 111. The end of the toner cartridge 111 is packed by the bottom of the pouch portion 32 and the inflated portion 31. As the air-packing device 30*a* completely surrounds an end of the toner cartridge 111, it can absorb the shocks and impacts from any direction.

Another embodiment example of the present invention is described with reference to FIGS. 7 to 10. Similar to the previous embodiment, the air-packing device in this embodiment is basically configured by the inflated portion and the pouch portion. The pouch portion is configured so as not to be inflated by the compressed air and is folded inside of the inflated portion. This configuration can be advantageously used for protecting a product that has relatively flat and rectangular object, such as a notebook computer, DVD driver, etc.

Figure 7:
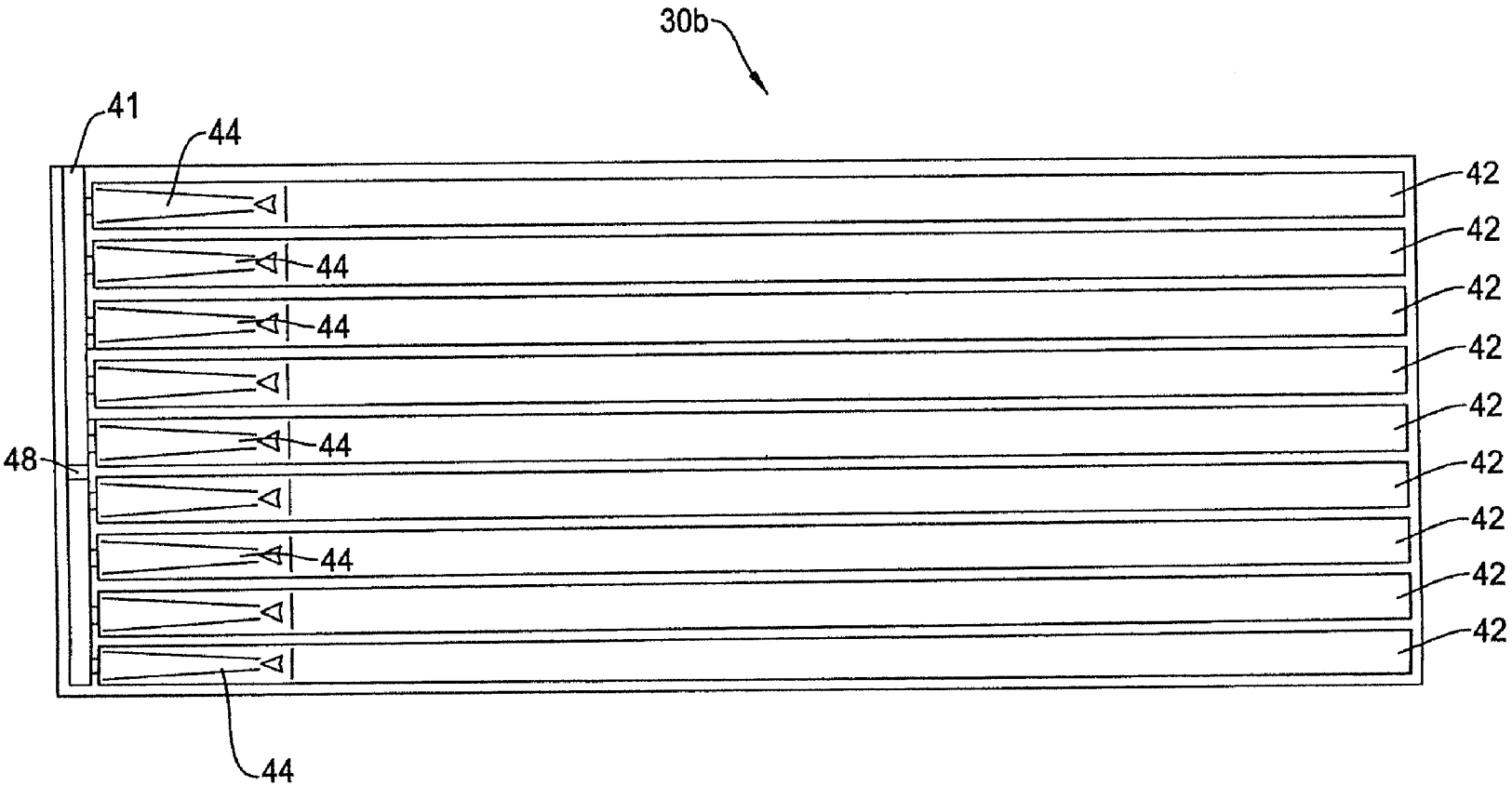
FIG. 7 is a plane view of the air-packing device in an another embodiment under the present invention wherein the air-packing device is not inflated.

FIG. 7 is a plan view showing an air-packing device of the present invention before being inflated by the air. This configuration is especially suited to hold and protect a notebook computer or a DVD driver that has a relatively thin and flat shape. It should be noted that this air-packing device 30*b* is used in a pair to protect a product similar to the previous embodiment described above. An example of actual use of the air-packing device 30*b* is shown in the perspective view of FIG. 10B, wherein a pair of air-packing devices 30*b* hold a product such as a notebook computer.

Referring back to FIG. 7, the air-packing device 30*b* is made of two thermoplastic films which are bonded (heat-sealed) together to create the plurality of air containers 42. Such bonded areas are denoted by reference numerals 46 and 47 which air-tightly separate the air containers 42 from one another. Typically, each air container 42 is provided with a check valve 44 at one end so that the compressed air is maintained in the air container because the check valve 44 prohibits a reverse flow of the air.

In the example of FIG. 7, the check valves 44 are provided at the left end of the air-packing device 30 and are commonly connected to an air input 41. When the compressed air is supplied through the air input 41, the air flows through the check valves 44 and inflates all of the air containers 42. The air introduced from the air input 41 is blocked by the air stopper 48, where the thermoplastic films are bonded with each other, thereby closing the air input 41 for the lower part of the air-packing device 30*b*.

Consequently, the air will flow to the upper five air containers 42 and will not flow to the lower four air containers 42 of the air-packing device 30*b* of FIG. 7. Thus, only the upper five air containers are filled with air. The lower part that is not inflated does not act as a cushion but will act as a pouch portion to hold a product to be protected as will be explained later in detail.

The left edge and the right edge of the air-packing device 30*b* of FIG. 7 is bonded to one another to form a continuous plane, i.e, a loop. Thus, when the air packing device 30*b* is filled with the compressed air, the air packing device 30*b* takes the configuration shown in the perspective view of FIG. 5A. The air-packing device 30*b* is bent at around the middle of the air containers 42 when the air is appropriately filled therein. It is also feasible to provide a heat-seal land (separator) such as shown in FIG. 3 to facilitate folding of the air-packing device 30*b*.

Figure 8A:
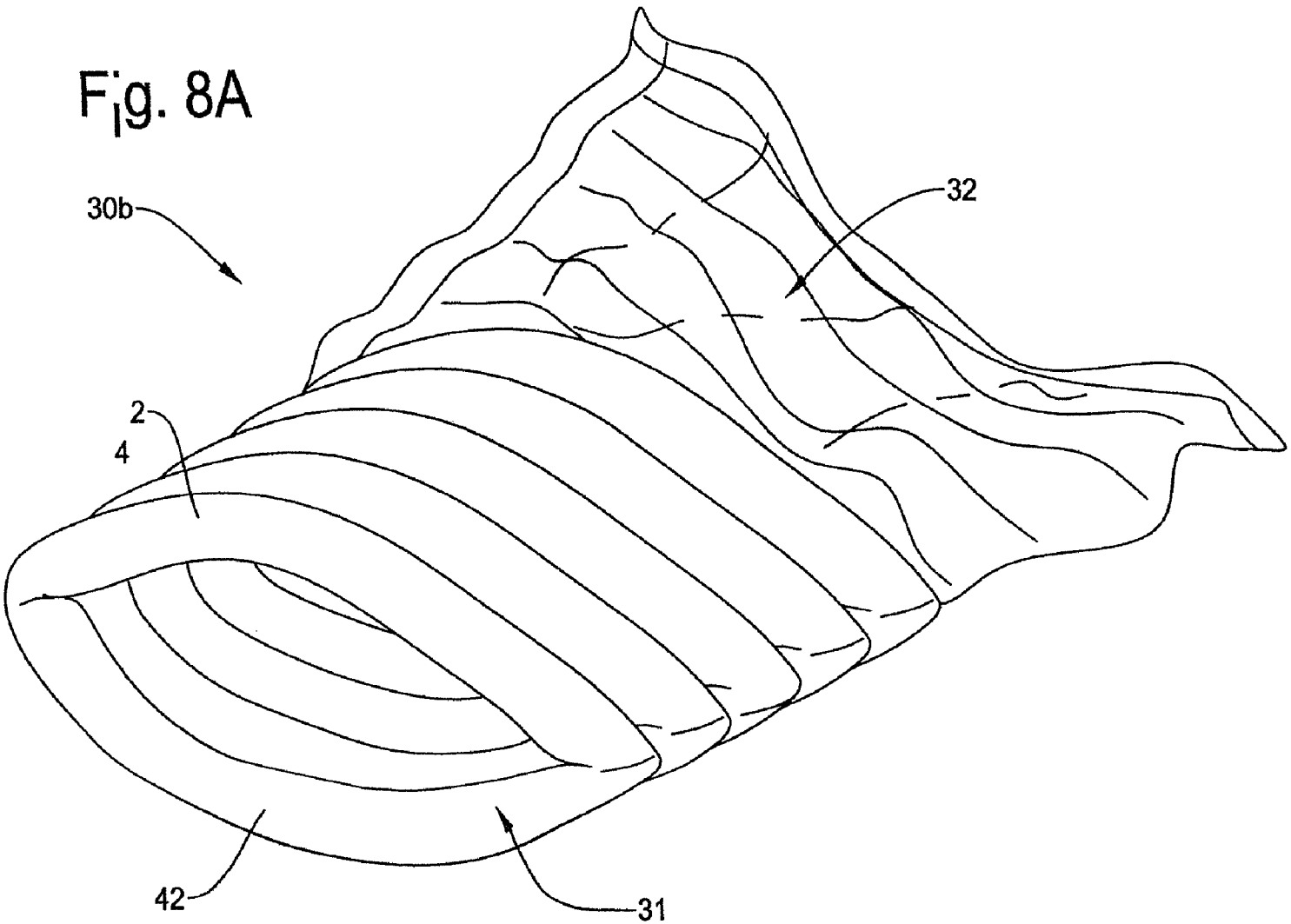
FIG. 8A is a perspective view of the air-packing device under the present invention wherein the air-packing device has an inflated portion and uninflated portion that forms a pouch.

As shown in FIG. 8A, the air-packing device 30*b* has an inflated portion 31 formed with the air containers 42 and a pouch portion 32 that is not filled with the air. The pouch portion 32 itself does not have the capacity to absorb the shocks and impacts because it is not filled with the air. However, the pouch portion 32 is turned inside out and inserted in the inflated portion 31 to make a pouch that is suitable to hold a product to be protected. In this example, the inflated portion 31 has a substantially oval structure.

Figure 8B:
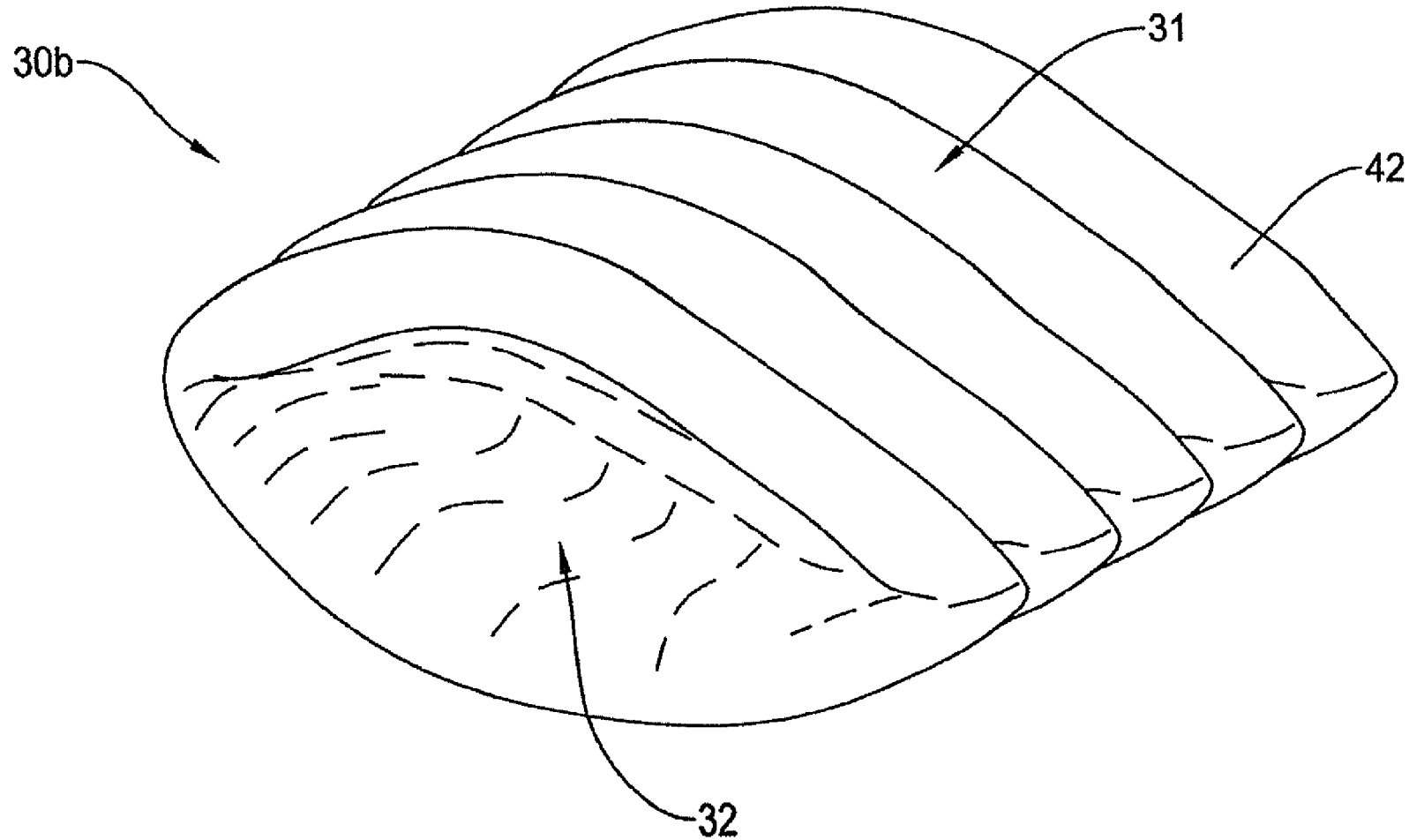
FIG. 8B is a perspective view of the air-packing device under the present invention wherein the air-packing device has an inflated portion and uninflated portion that has been flipped in to form a pouch.

Referring to the perspective view shown in FIG. 8B, the condition of the air-packing device 30*b* wherein the pouch portion 32 has been turned inside out to make a pouch is described. The pouch portion 32 which is not provided with the compressed air is turned inside out and is provided within the space of the inflated portion 31. One end of a product to be protected, such as a notebook computer, is inserted into the pouch portion 32 and contacts the bottom of the pouch portion 32. The pouch portion 32 can stabilize the position of the product to be protected because the bottom of the pouch portion prevents the product to move toward the end of the inflated portion 31.

Moreover, the pouch portion 32 prevents direct contact of the product with the inflated portion 31. When the product is inserted in the pouch portion 32, the product will not directly touch the inflated portion that is filled with compressed air. Although a produce may have a relatively sharp edge or corner, since such a sharp part of the product will not contact the inflated portion 31, the air-packing device 30*b* will not be punctured by the product.

In the present embodiment example, the pouch portion 32 is made of two sheets of thermoplastic films which are heat-sealed by the same pattern as that of the inflated portion 31. Thus, the pouch portion 32 is reinforced in this manner. Even if only one sheet is used for the pouch portion 32, the durability of the air-packing device 30*b* will be increased as the product does not directly touch the inflated portion 31. Thus, the pouch portion 32 increases the reliability of the air-packing device 30*b*.

Figure 9:
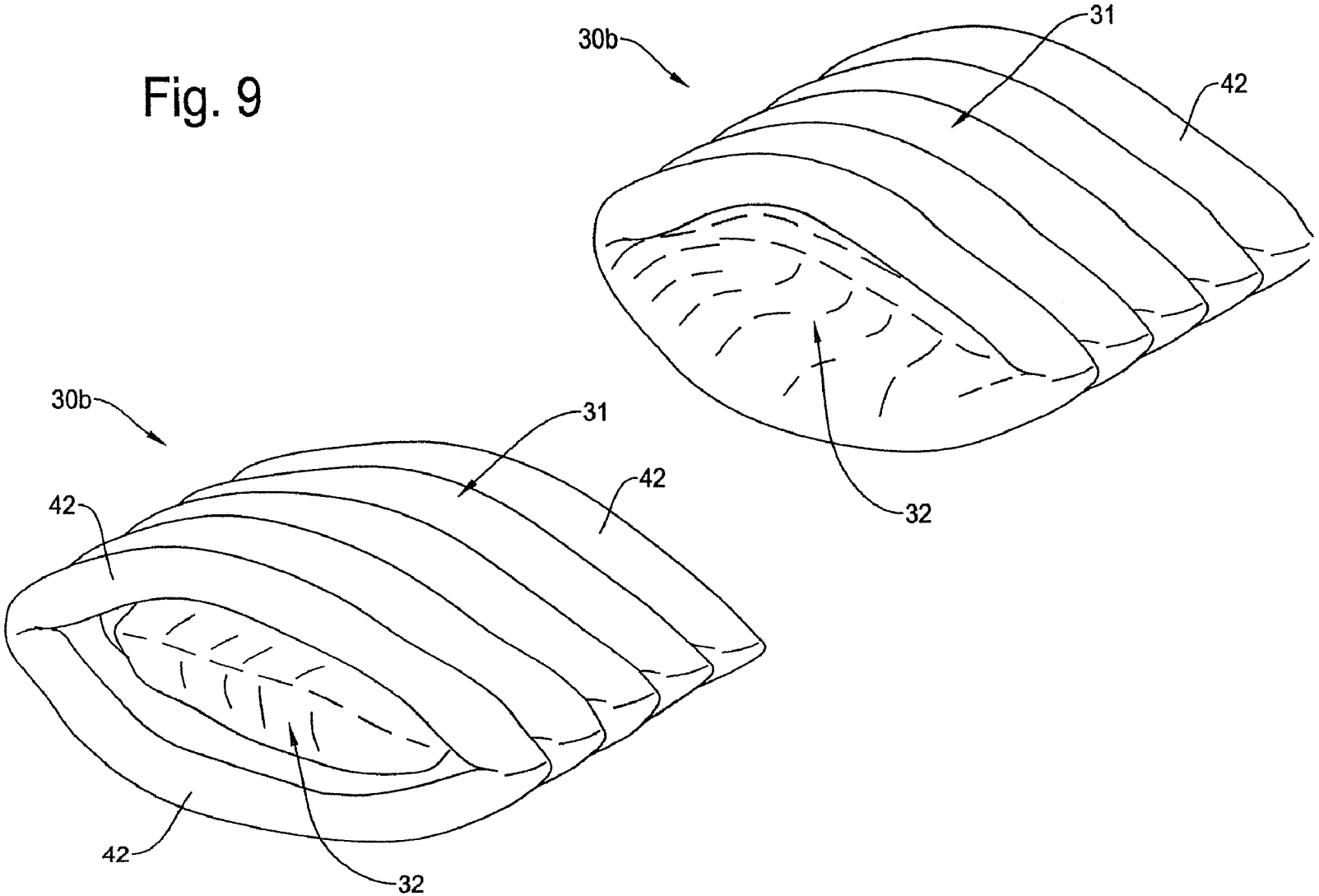
FIG. 9 is a perspective view of a pair of air-packing devices under the present invention that are aligned in the same condition that they are used to protect a package.

FIG. 9 is a perspective view showing a pair of air-packing devices 30*b* that are aligned in the same condition as that when the air-packing devices 30*b* are used to hold a product to be protected. The air-packing device 30*b* on the left shows the inflated portion 31 and the bottom back of the pouch portion 32 inside the inflated portion 31. The air-packing device 30*b* on the right shows the inflated portion 31 and the front of the pouch portion 32 inside the inflated portion 31. It should be noted that the bottom of the pouch portion 32 do not reach the end of the inflated portion 31 so that the bottom of the pouch portion 32 will not contact the container box when installed therein.

Figure 10A:
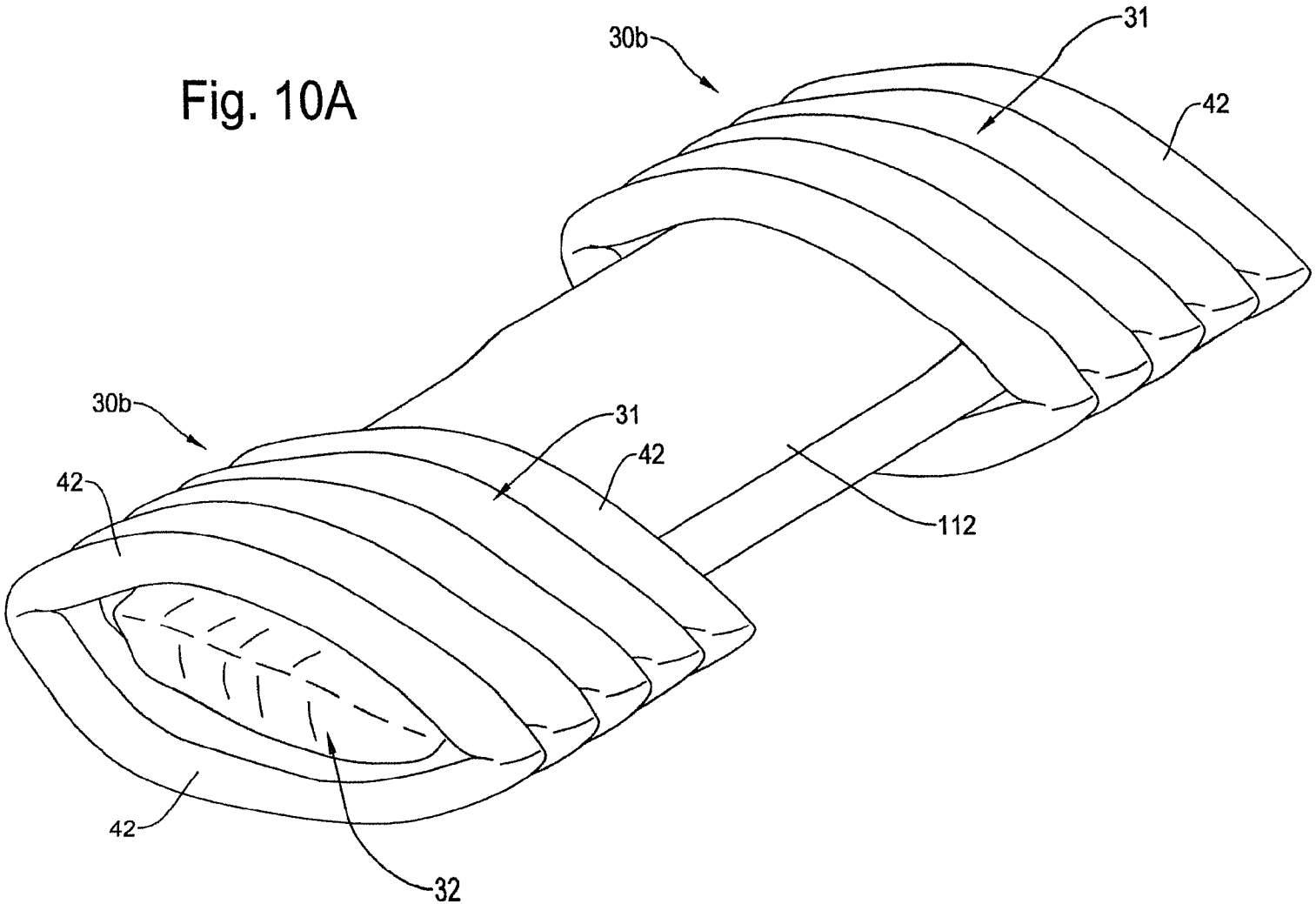
FIG. 10A is a perspective view of a pair of air-packing devices under the present invention and a notebook computer that is securely held in the pouch portions of the air-packaging devices for protection.
Figure 10B:
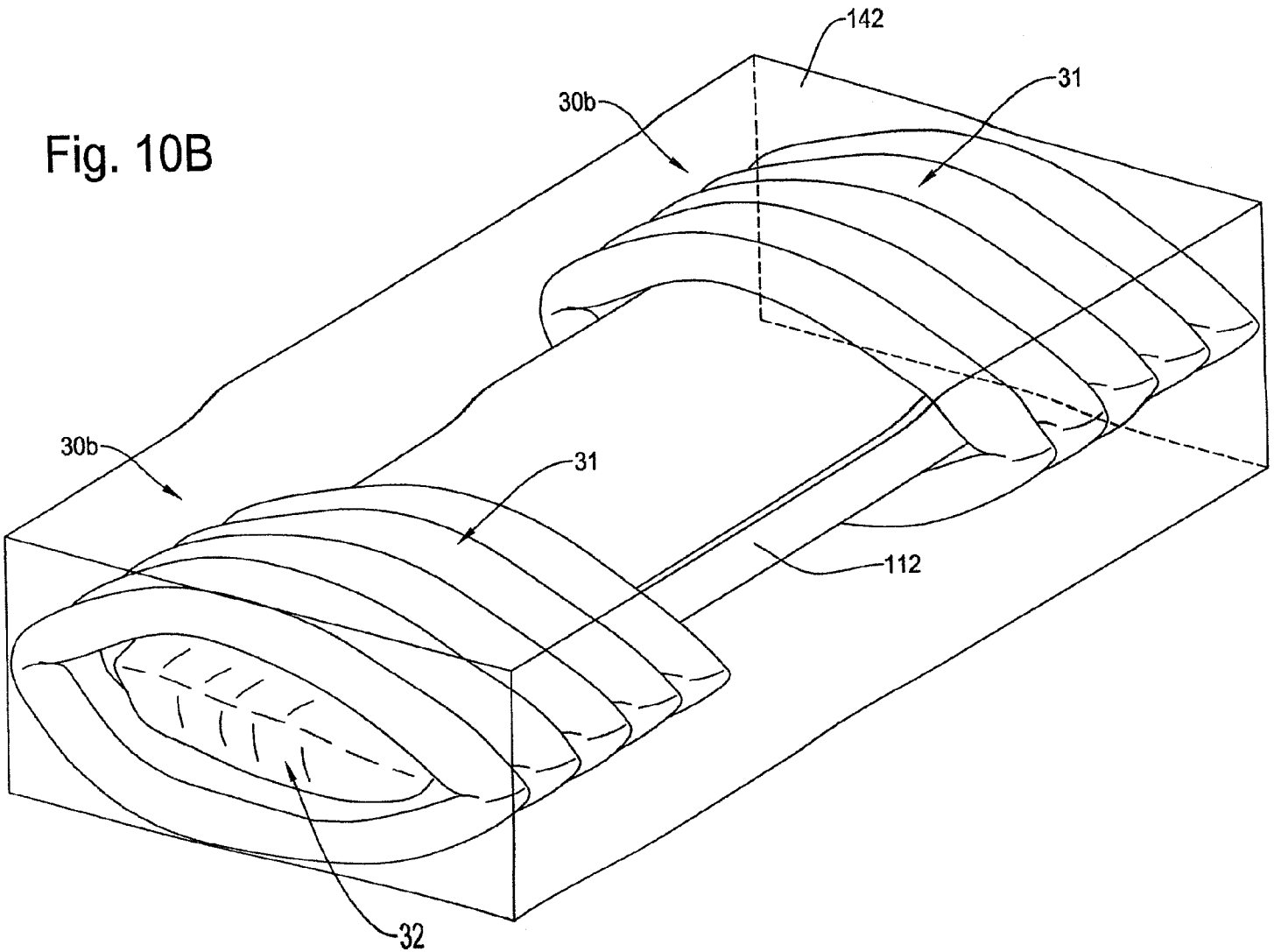
FIG. 10B is a perspective view of a pair of air-packing devices under the present invention and a notebook computer similar to that in FIG. 10A except that they are placed in a carton box.

FIG. 10A is a perspective view similar to that shown in FIG. 9 except that the air-packing devices 30*b* cover the ends of the product to be protected (ex. toner cartridge) for shock absorption. Normally, the toner cartridge and the air-packing devices 30*a* are placed in a container box, such as a corrugated carton, for transportation. FIG. 10B is a perspective view wherein the toner cartridge and the air-packing devices 30*b* are placed in a container box 142. The carton box 142 is preferably of the size and shape that snugly hold the toner cartridge and the air-packing devices 30*b* inside therein.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. A packaging device comprising:

first and second thermoplastic films superposed with each other and extending between a first end and a second end along a first direction, and having a first section close to the first end and a second section close to the second end and connected to the first section, each section extending along the first direction, wherein predetermined portions of the first and second thermoplastic films in the first section are bonded, creating a plurality of fluid containers;

a plurality of check valves each connected to a corresponding fluid container;

a fluid passage extending along the first direction and connected to the check valves;

wherein the first section is an inflatable section and the second section is an uninflatable section;

wherein the first and second thermoplastic films are folded and two side edges of the films are bonded and an edge at the second end is bonded to form an enclosure; and wherein the uninflatable section is folded into the inflatable section to form a pouch.

2. The packaging device as defined in claim 1, wherein the inflatable section has a substantially trapezoid shape when inflated.

3. The packaging device as defined in claim 1, wherein the inflatable section has a substantially oval shape when inflated.

4. The packaging device of claim 1, wherein the fluid passage extends between the first end and the second end, and has a stopper at a point between the first end and the second end.

5. The packaging device of claim 4, wherein the stopper is formed by bonding a portion of the first and second thermoplastic films in the fluid passage.

6. The packaging device of claim 1, further comprising a plurality of heat-seal lands each bonding the first and second thermoplastic films in an area of the fluid container to create a plurality of series connected cells in each fluid container, the heat-seal lands are positioned in the fluid container in a manner to allow a fluid flow between the cells.

* * * * *